United States Patent [19]

Goldstein

[11] Patent Number: 5,007,441

[45] Date of Patent: Apr. 16, 1991

[54] ELECTRIC NAIL POLISH REMOVER

[76] Inventor: Michael D. Goldstein, P.O. Box 391, Gladwyne, Pa. 19035

[21] Appl. No.: 459,250

[22] Filed: Dec. 29, 1989

[51] Int. Cl.[5] ..... A45D 29/05

[52] U.S. Cl. ..... 132/73.6; 132/75.8; 15/97.1

[58] Field of Search ..... 132/73, 73.5, 73.6, 132/74.5, 75.8, 76.4; 15/21 R, 97 R

[56] References Cited

U.S. PATENT DOCUMENTS

| | | | |
|---|---|---|---|
| 1,814,625 | 7/1931 | Foerster | 132/73.6 |
| 2,424,509 | 7/1947 | Singer | 15/97 R |
| 3,216,034 | 11/1965 | Johnson | 132/73.6 |
| 4,255,826 | 3/1981 | Boyd | 132/73.6 |
| 4,319,596 | 3/1982 | Jackson | 132/73.6 |
| 4,478,232 | 10/1984 | Yasuda | 132/73.6 |
| 4,510,954 | 4/1985 | Miller | 132/73.5 |
| 4,627,758 | 12/1986 | Winthrop | 132/74.5 |
| 4,800,606 | 1/1989 | Kolesky | 132/73.6 |

*Primary Examiner*—John J. Wilson
*Assistant Examiner*—F. LaViola
*Attorney, Agent, or Firm*—Leon Gilden

[57] ABSTRACT

An electric nail polish remover is provided with an underlying housing including a motor means provided with a drive shaft rotatably extending from the lower housing to an upper coaxial housing in a sealing relationship relative to the lower housing, wherein the upper housing contains a cavity for inclusion of a reservoir containing a quantity of fingernail polish remover fluid with a continuous endless belt directed through the fluid and in cooperation with the drive shaft and directed about a series of five finger positions, wherein the finger positions each include a fingernail ledge member to direct the fingernail in operative association with the belt for removal of fingernail polish positioned on the fingernail.

7 Claims, 4 Drawing Sheets

ELECTRIC NAIL POLISH REMOVER

BACKGROUND OF THE INVENTION

1. Field of the Invention

The field of invention relates to fingernail polish removal apparatus, and more particularly pertains to a new and improved fingernail polish removal apparatus wherein the same employs a continuous belt directed through a fingernail polish removal solution to remove fingernail polish from an associated fingernail.

2. Description of the Prior Art

Fingernail polish removal has been primarily conducted by the arduous and time consuming means of individually applying a fingernail polish removal fluid to a fingernail by the individual on a sequential basis to remove fingernail polish previously applied to associated fingernails. Mechanical apparatus has been attempted in an effort to expedite this lengthy procedure, but has heretofore been of a relatively complex or inefficient organization to effect this purpose. Examples of the prior art include U.S. Pat. No. 4,510,954 to Miller utilizing a fingernail polish removal organization wherein a series of coaxially aligned brushes rotate overlying fingernails positioned within grooves underlying the brushes for removal of fingernail polish from the fingernails as the brushes are directed over a removal solution.

U.S. Pat. No. 4,478,232 to Yasuda sets forth a fingernail polisher wherein a rotating motor as a driving source provides rotating motion to a polishing cylinder and reciprocatory motion of the filing plates to effect a polishing of fingernails positioned within the organization.

U.S. Pat. No. 4,800,606 to Kolesky sets forth a fingernail cleaning organization utilizing five rotatably mounted spaced cleaning members and drive means for rotating the cleaning members about their axes, wherein fingernails positioned within the rotating members positions the liners of the members against the nail to rotate and clean the nail as it is positioned relative to the liner of each rotating member.

U.S. Pat. No. 4,319,596 to Jackson sets forth a nail polishing device wherein a rotating drum is operably mounted to be positioned adjacent an aperture for receiving a fingernail therethrough, wherein the drum is directed through a solution to effect this purpose.

U.S. Pat. No. 4,255,826 to Boyd provides a motor driven cup member supported on a structure for rotation about a vertical axis, wherein an external switch is operated by one hand while the fingers of the other hand are inserted one at a time into the cup to remove nail polish from the fingernails.

As such, it may be appreciated that there is a continuing need for a new and improved fingernail polish removal apparatus which addresses both the problems of ease of use and effectiveness in organization and in this respect, the present invention substantially fulfills this need.

SUMMARY OF THE INVENTION

In view of the foregoing disadvantages inherent in the known types of fingernail polish removal apparatus now present in the prior art, the present invention provides a fingernail polish removal apparatus wherein the same utilizes spaced wells stationarily mounted within a housing to position fingernails adjacent a relatively moving continuous belt for removal of fingernail polish from an associated fingernail. As such, the general purpose of the present invention, which will be described subsequently in greater detail, is to provide a new and improved fingernail polish removal apparatus which has all the advantages of the prior art fingernail polish removal organizations and none of the disadvantages.

To attain this, the present invention sets forth a fingernail polish removal apparatus wherein the same includes a lower housing formed with a motor means with a shaft directed upwardly therefrom. The shaft is in operative engagement and drives a continuous belt member, wherein the belt member is directed through a series of five positions, the five positions are each provided with positioning ledges to position the fingernails adjacent the belt. The belt is formed with a rear face formed with cogged teeth for cooperation with the motor shaft and guide shafts formed within the upper housing, and wherein the belt further forms a sponge-like forward surface that is directed through a fingernail polish removal solution within the cavity of the upper housing to direct the solution against the fingernail portions of an individual's fingers positioned within the positions.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved fingernail polish removal apparatus which has all the advantages of the prior art fingernail polish removal apparatus and none of the disadvantages.

It is another object of the present invention to provide a new and improved fingernail polish removal apparatus which may be easily and efficiently manufactured and marketed.

It is a further object of the present invention to provide a new and improved fingernail polish removal apparatus which is of a durable and reliable construction.

An even further object of the present invention is to provide a new and improved fingernail polish removal apparatus which is susceptible of a low cost of manufacture with regard to both materials and labor, and which accordingly is then susceptible of low prices of sale to the consuming public, thereby making such fingernail polish removal apparatus economically available to the buying public.

Still yet another object of the present invention is to provide a new and improved fingernail polish removal apparatus which provides in the apparatuses and methods of the prior art some of the advantages thereof, while simultaneously overcoming some of the disadvantages normally associated therewith.

Still another object of the present invention is to provide a new and improved fingernail polish removal apparatus wherein the same simultaneously removes fingernail polish from the five digits of an associated individual including self and contained actuator means within the apparatus to automatically engage and disengage a power motor to operate the organization.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
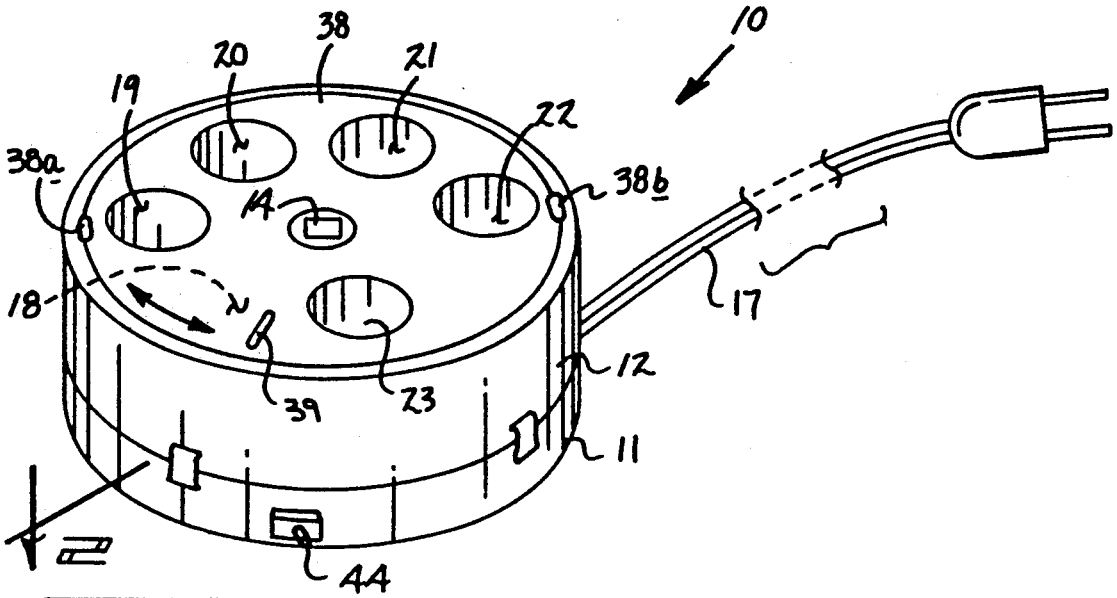
FIG. 1 is an isometric illustration of the instant invention.
Figure 2:
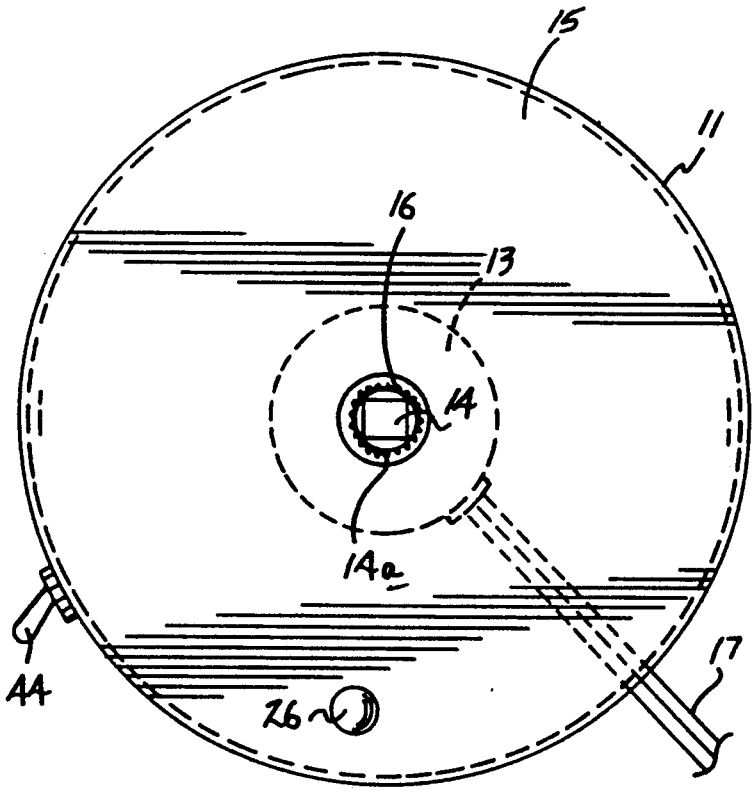
FIG. 2 is a top orthographic view taken along the section line 2 of FIG. 1 in the direction indicated by the arrow.

With reference now to the drawings, and in particular to FIGS. 1 to 10 thereof, a new and improved fingernail polish removal apparatus embodying the principles and concepts of the present invention and generally designated by the reference numeral 10 will be described.

More specifically, the fingernail polish removal apparatus 10 essentially comprises a lower cylindrical housing 11 with an upper cylindrical housing 12 mounted thereon in a coaxial coextensive relationship. The lower housing 11 includes an electrical reversible motor 13 with a square cross-section drive shaft 14 projecting coaxially and upwardly of the lower housing 11 to minimize torquing of the housing during rotation of the motor. The shaft 14 projects through the roof 15 with a fluid seal 16 positioned and arranged about the shaft 14 within the roof 15 to prevent fluid from the upper housing 12 inadvertanly entering the lower housing. A power supply cord 17 electrically communicates the motor 13 with appropriate electrical energy, wherein alternatively a battery supply may be utilized (not shown) of conventional construction for powering of the motor 13. The upper and lower housing 11 and 12 are securable together by a series of clips 36.

Figure 4:
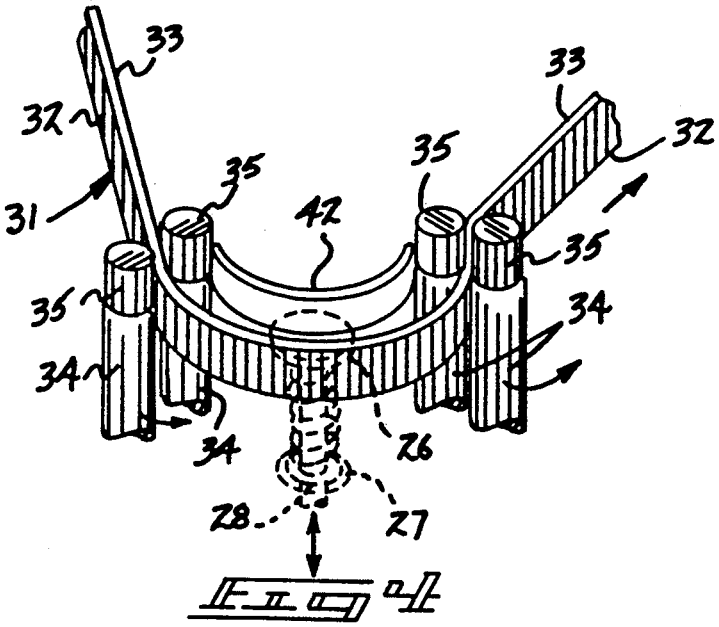
FIG. 4 is an enlarged isometric illustration of a finger position organization of the instant invention.
Figure 5:
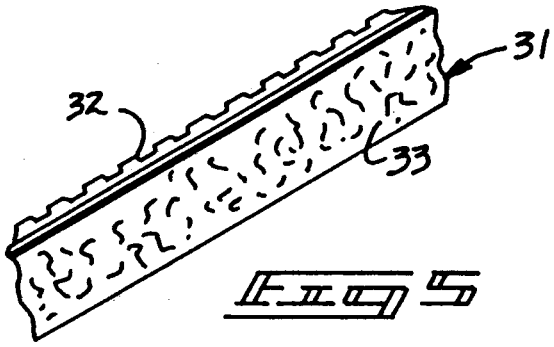
FIG. 5 is an isometric sectional illustration of the endless belt utilized by the instant invention.
Figure 6:
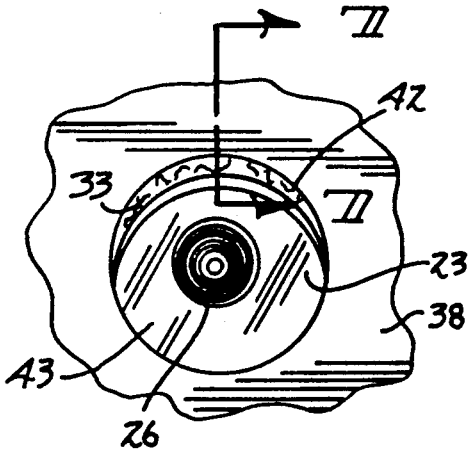
FIG. 6 is a top orthographic view of a finger opening through the lid utilized by the instant invention.
Figure 7:
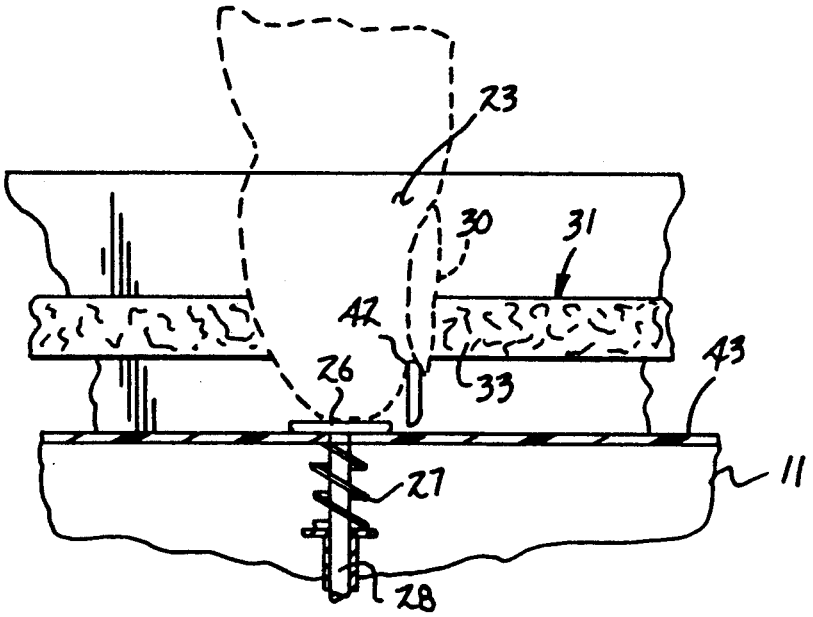
FIG. 7 is an orthographic view taken along the lines 7—7 of FIG. 6 in the direction indicated by the arrows.
Figure 8:
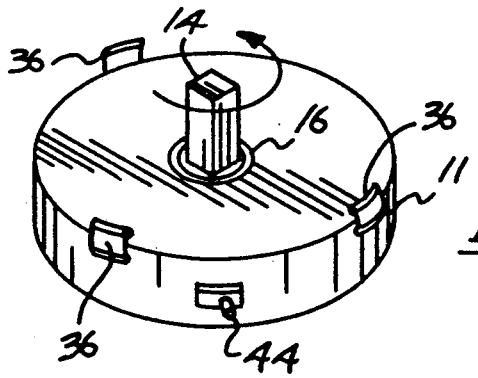
FIG. 8 is an isometric illustration of the drive shaft extending from the lower housing.

The upper housing 12 is defined by an internal cavity 18 as it overlies the roof 15 of the lower housing 11 and is formed with a series of five finger portions defined as underlying five finger openings through a removable cover lid 38 including a first finger opening 19, a second finger opening 20, a third finger opening 21, and a fourth finger opening 22, with a fifth thumb opening 23 arranged within the housing 12. The openings 19 through 23 are in a predetermined relationship orthogonally and axially parallel offset relative to the axis of the upper and lower cylindrical housings 11 and 12. The first, second, third, and fourth finger openings 19 through 22 are spaced in a semi-circular array within a semi-circle defined by the diameter "D" of the upper cylindrical housing with the fifth thumb opening 23 positioned on a bisecting diameter of the diameter "D" bisecting the spacing of the second and third openings 20 and 21. This arrangement properly positions an individual's thumb within the fifth thumb opening 23. Each of the finger wells 19 through 22 is formed with a finger abutment 25 aligned with the lower terminal end of each well to properly position the end of each individual's finger within the well, wherein the fifth thumb well 23 is provided with a thumb actuator abutment switch 26 that is reciprocatably mounted in the lower housing 11 and biased upwardly, as illustrated in FIG. 4, by spring 27 positioned about a switch shaft 28 within a lowermost portion of the thumb well 23, whereupon positioning of an individual's thumb within the well 23 engages the thumb actuator switch 26 to energize the electrical motor 13. A flexible sealing membrane formed in the floor of the upper housing 11 enables reciprocation of the switch 26 by thumb pressure thereto, as illustrated in FIG. 7. It should be noted that a polarity switch 44 extends exteriorly of the lower housing 11 to effect selective reversing of the motor 13 to enable directional reversing of a captured serpentine endless belt 31, to be discussed in more detail below.

Figure 3:
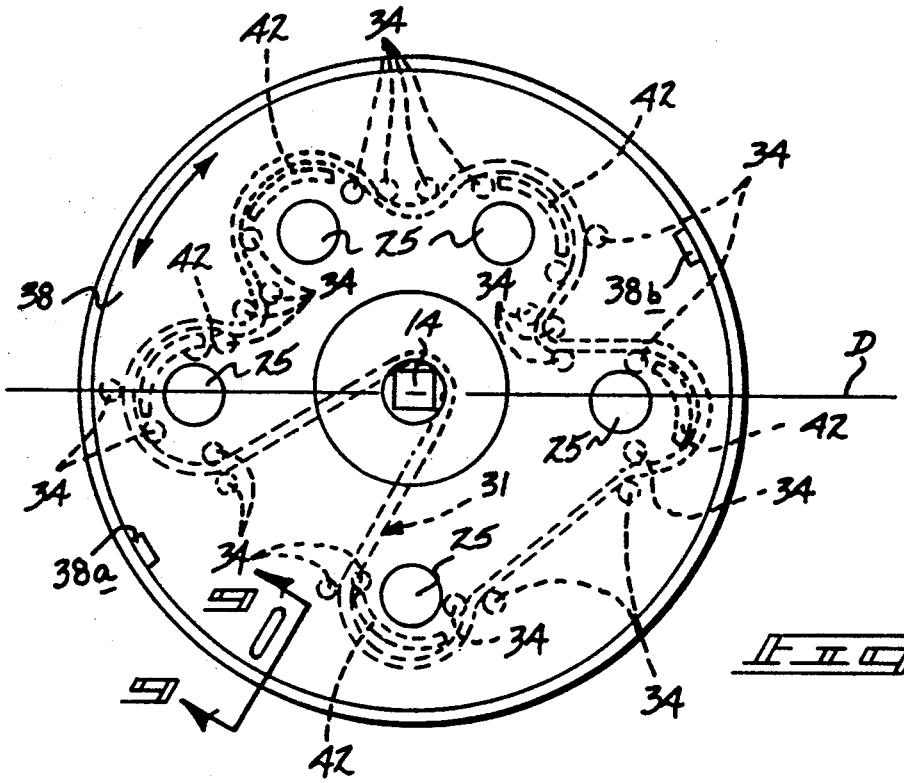
FIG. 3 is a top orthographic plan view of the upper housing, as illustrated in FIG. 1.

A continuous endless belt 31 is operatively associated with the drive shaft 14 of the electrical motor and with splined upper shaft portions 35 of a series of rotatable guide rods 34 to provide the circuitous route of the endless belt 31 as it is directed through each of the finger positions when driven by the drive shaft 14, as illustrated in FIG. 3 for example. The endless belt 31 is provided with a toothed inner face 32 to cooperate with the spline upper shaft portions 35 of each of the rotatable guide rods 34 and with a splined coupler **14*a* of the drive shaft 14. A forward sponge applicator face 33 is positioned and directed interiorly of the belt 31 and surroundingly confronts each of finger positions for contact with an individual's fingernail positioned through each of the openings 19 and 23. The fingernails of each of the fingers positioned through the openings are properly oriented for engagement with the sponge applicator face 33 of the endless belt by a fingernail positioning abutment ledge of generally arcuate configuration about a forward surface thereof to underlie an individual's fingernail and thereby associate the fingernail with relationship to the sponge applicator face 33, as illustrated in FIG. 7. It should be noted that the serpentine belt 31 provides a surrounding relationship to each ledge 42 defined by approximately 180 degrees underlying finger positions 19 through 22. The belt 31, however, defines an arc of at least 270 degrees about the thumb position underlying opening 23 as an individual's thumb is rotated from a left hand to a right hand thumb positioned through the thumb opening 23. The internal cavity 18 of the upper housing 12 is filled with an appropriate fingernail removal liquid, such as scented lacquer thinner as is conventionally utilized upon removal of the removable lid 38**.

Figure 9:
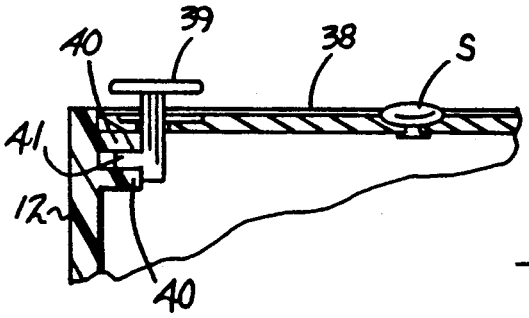
FIG. 9 is an orthographic view taken along the lines 9—9 of FIG. 3 in the direction indicated by the arrows.
Figure 10:
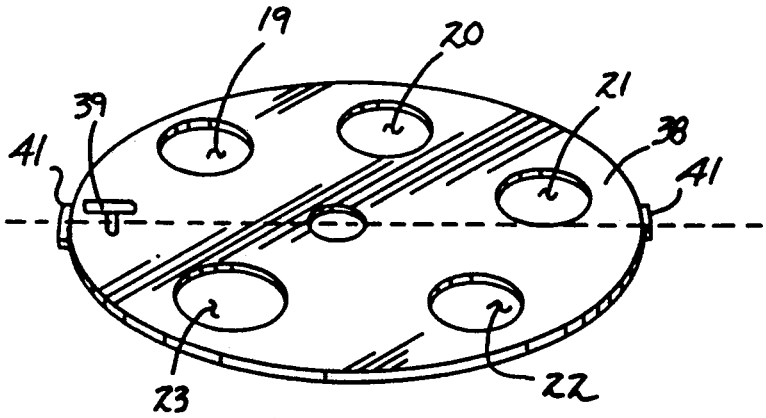
FIG. 10 is an isometric illustration of the rotatable lid removably mounted within the upper end of the upper housin of the invention.

The cover lid 38 is rotatably mounted and containing each of the openings of the finger openings 19 through 23 wherein rotatable cover lid is formed with a handle 39 to enable manual manipulation and rotation of the lid that is positioned between spaced annular flanges 40 directed interiorly of the upper side wall of the upper housing 12, as illustrated in FIG. 9 for example. The lid 38 is provided with cover lid flanges **38*a* diametrically opposed in relationship to the sides of the lid 38 whereupon rotation of the lid 38 in alignment with first and second slots 38*a* and 38*b* formed diametrically opposed to one another within the upper flange of the spaced flanges 40 enables removal of the lid 38 to gain access to the endless belt 31** for replacement and service thereof.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A fingernail polish removal apparatus comprising, a lower housing mounted overlying an upper housing, and motor means selectively actuatable mounted within the lower housing medially thereof and including a rotatable shaft projecting into the upper housing from the lower housing, and a series of five fingernail positions formed within the upper housing, and elongate cleaning means directed surroundingly about each position in operative association with the shaft for contact and cleaning of a fingernail of an associated finger directed into each position, and wherein the five fingernail positions defined by four finger positions and one thumb position, and a lid is removably mounted to the upper end of the upper housing including an individual opening coaxially aligned with each finger position and thumb position, and wherein the upper and lower housing are of circular configuration and coaxially aligned relative to one another, and wherein the four finger positions are positioned in a semi-circular array within a semi-cylindrical portion of the upper housing with the thumb position oriented through a diameter bisecting the semi-circular array of the four finger positions, the thumb position including an actuator switch abutment at a lower terminal end of the thumb position for actuation of the motor means and the shaft, wherein the actuator switch is mounted within the lower housing underlying a flexible membrane mounted in a floor portion of the upper housing, and wherein the shaft includes a splined upper portion in engagement with a toothed inner face of the elongate cleaning means, and the elongate cleaning means is defined by an endless serpentine belt, the serpentine belt further including a sponge face opposed to the toothed face directed interiorly of each finger and thumb position.

2. A fingernail polish removal apparatus as set forth in claim 1 wherein each finger and thumb position further includes an arcuate ledge positioned adjacent the sponge face of the serpentine belt directed through each finger and thumb position.

3. A fingernail polish removal apparatus as set forth in claim 2 wherein the upper housing includes a fluid chamber for receiving a fingernail polish removal solution therewithin.

4. A fingernail polish removal apparatus as set forth in claim 3 wherein each finger and thumb position is defined by a plurality of rotatable rods including splined upper ends for engagement with the toothed inner face of the endless belt for orienting the belt relative to each finger and thumb position to guide the belt in a circuitous path through the upper housing.

5. A fingernail polish removal apparatus as set forth in claim 4 wherein the lid is rotatably mounted within the upper housing and includes a plurality of diametrically opposed flanges slidably mounted within annular flanges of the upper housing, the upper flanges include diametrically opposed notches to enable positioning of the flanges of the lid and removal of the lid for access to the continuous belt for repair and servicing thereof.

6. A fingernail polish removal apparatus as set forth in claim 5 including a reversing switch to reverse direction of the electric motor and the serpentine belt.

7. A fingernail polish removal apparatus as set forth in claim 6 wherein the serpentine belt is in surrounding relationship to each finger position defining an arc of substantially 180 degrees with the serpentine belt surrounding the thumb position defining an arc of substantially 270 degrees.

* * * * *